US005836629A

United States Patent [19]

Hobart

[11] Patent Number: 5,836,629

[45] Date of Patent: Nov. 17, 1998

[54] DISPOSABLE ANIMAL WASTE RECEPTACLE

[76] Inventor: Stephen John Hobart, 17 Park Drive, Wickford Essex, United Kingdom, SS12 9DJ

[21] Appl. No.: 933,163

[22] Filed: Sep. 18, 1997

[51] Int. Cl.[6] ..... A01K 29/00; E01H 1/12

[52] U.S. Cl. ..... 294/1.3; 294/25

[58] Field of Search ..... 294/1.3–1.5, 25, 294/55; 15/104.8, 257.1, 257.6, 227; 383/4

[56] References Cited

U.S. PATENT DOCUMENTS

| | | | |
|---|---|---|---|
| 3,813,121 | 5/1974 | Marvin | 294/1.3 |
| 3,850,467 | 11/1974 | Johnson | 294/1.3 |
| 3,978,540 | 9/1976 | Peck et al. | 294/1.3 |
| 4,132,442 | 1/1979 | Larsson | 294/1.3 |
| 4,768,818 | 9/1988 | Kolic | 294/1.3 |
| 5,149,159 | 9/1992 | Bardes | 294/1.3 |
| 5,222,777 | 6/1993 | Clonch | 294/1.3 |
| 5,282,660 | 2/1994 | Halling | 294/1.3 |

FOREIGN PATENT DOCUMENTS

| | | | |
|---|---|---|---|
| 2645188 | 10/1990 | France | 294/1.3 |
| 3909418 | 11/1989 | Germany | 294/1.3 |
| 661077 | 6/1987 | Switzerland | 294/1.3 |
| 9208345 | 5/1992 | WIPO | 294/1.3 |

*Primary Examiner*—Johnny D. Cherry

[57] ABSTRACT

An animal waste disposal receptacle for picking up animal waste from a surface and containing the waste for disposal. The receptacle includes a disposable bag having disposable scoop members mounted thereon for scooping up the animal waste and placing the waste in the receptacle.

11 Claims, 2 Drawing Sheets

DISPOSABLE ANIMAL WASTE RECEPTACLE

BACKGROUND OF THE INVENTION

1. Field of the Invention

The present invention relates to waste receptacles and more particularly pertains to a new disposable waste receptacle for picking up animal waste from a surface and containing the waste for disposal.

2. Description of the Prior Art

The use of waste receptacles is known in the prior art. More specifically, waste receptacles heretofore devised and utilized are known to consist basically of familiar, expected and obvious structural configurations, notwithstanding the myriad of designs encompassed by the crowded prior art which have been developed for the fulfillment of countless objectives and requirements.

Known prior art waste receptacles include U.S. Pat. No. 4,909,553; U.S. Pat. No. 4,186,955; U.S. Pat. No. 297,474; U.S. Pat. No. 4,875,729; U.S. Pat. No. 5,370,431; and U.S. Pat. No. 5,400,572.

While these devices fulfill their respective, particular objectives and requirements, the aforementioned patents do not disclose a new disposable animal waste receptacle. The inventive device includes a disposable bag having a disposable scooping means.

In these respects, the disposable animal waste receptacle according to the present invention substantially departs from the conventional concepts and designs of the prior art, and in so doing provides an apparatus primarily developed for the purpose of picking up animal waste from a surface, and containing the waste for disposal.

SUMMARY OF THE INVENTION

In view of the foregoing disadvantages inherent in the known types of waste receptacles now present in the prior art, the present invention provides a new construction wherein the same can be utilized for picking up animal waste from a surface and containing the waste for disposal.

The general purpose of the present invention, which will be described subsequently in greater detail, is to provide a new apparatus and method which has many of the advantages of the waste receptacles mentioned heretofore and many novel features that result in a new disposable animal waste receptacle which is not anticipated, rendered obvious, suggested, or even implied by any of the prior art waste receptacles, either alone or in any combination thereof.

To attain this, the present invention generally comprises a disposable bag having a disposable scooping means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new apparatus and method which has many of the advantages of the waste receptacles mentioned heretofore and many novel features that result in a new disposable animal waste receptacle which is not anticipated, rendered obvious, suggested, or even implied by any of the prior art waste receptacles, either alone or in any combination thereof.

It is another object of the present invention to provide a new disposable animal waste receptacle, which may be easily and efficiently manufactured and marketed.

It is a further object of the present invention to provide a new disposable animal waste receptacle, which is of a durable and reliable construction.

An even further object of the present invention is to provide a new disposable animal waste receptacle which is susceptible of a low cost of manufacture with regard to both materials and labor, and which accordingly is then susceptible of low prices of sale to the consuming public, thereby making such economically available to the buying public.

Still yet another object of the present invention is to provide a new disposable animal waste receptacle which provides in the apparatuses and methods of the prior art some of the advantages thereof, while simultaneously overcoming some of the disadvantages normally associated therewith.

Still another object of the present invention is to provide a new disposable animal waste receptacle for picking up animal waste from a surface and containing the waste for disposal.

Yet another object of the present invention is to provide a new disposable animal waste receptacle which includes a disposable bag having a disposable scooping means. The present invention is completely disposable so that no soiled portions must be retained.

Still yet another object of the present invention is to provide a new animal waste receptacle that is easily contained within a clothing pocket prior to use and completely disposable after use with no need to retain parts of it for use of the next receptacle.

Even still another object of the present invention is to provide a new disposable animal waste receptacle that is easily packaged within a dispensing container with a plurality of similar receptacles for ease of use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
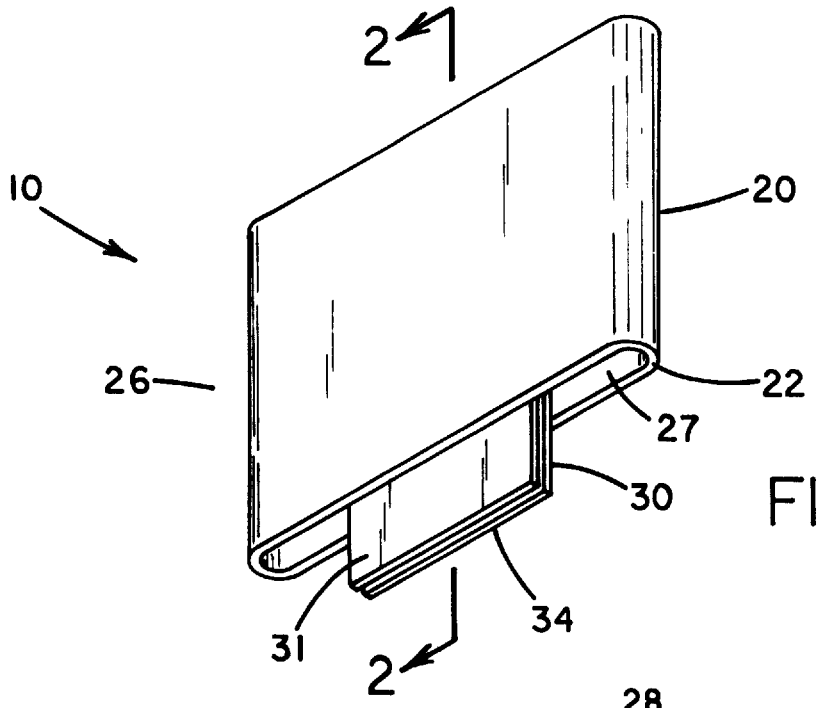
FIG. 1 is a perspective view of a folded embodiment of a new disposable animal waste receptacle according to the present invention.
Figure 2:
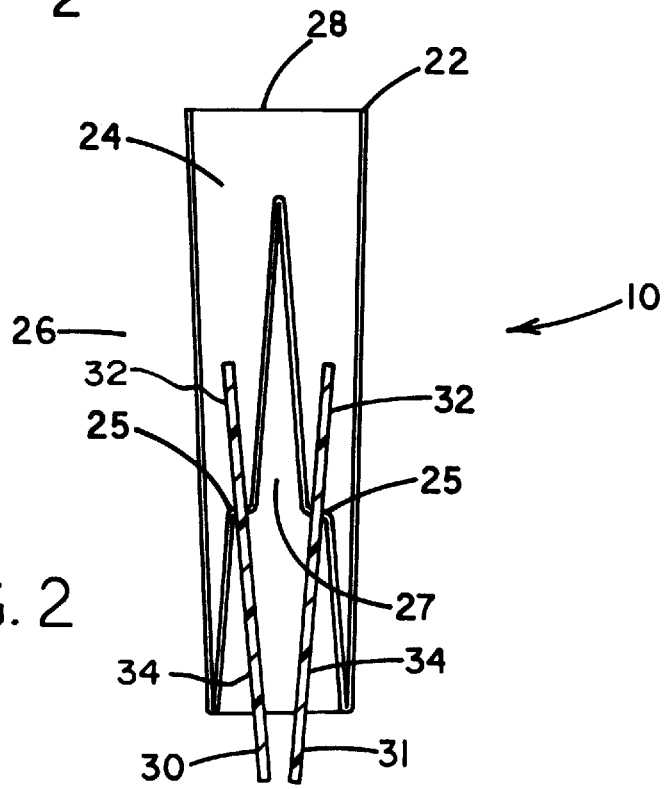
FIG. 2 is a side elevation view of the present invention taken from line 2—2 on FIG. 1.
Figure 3:
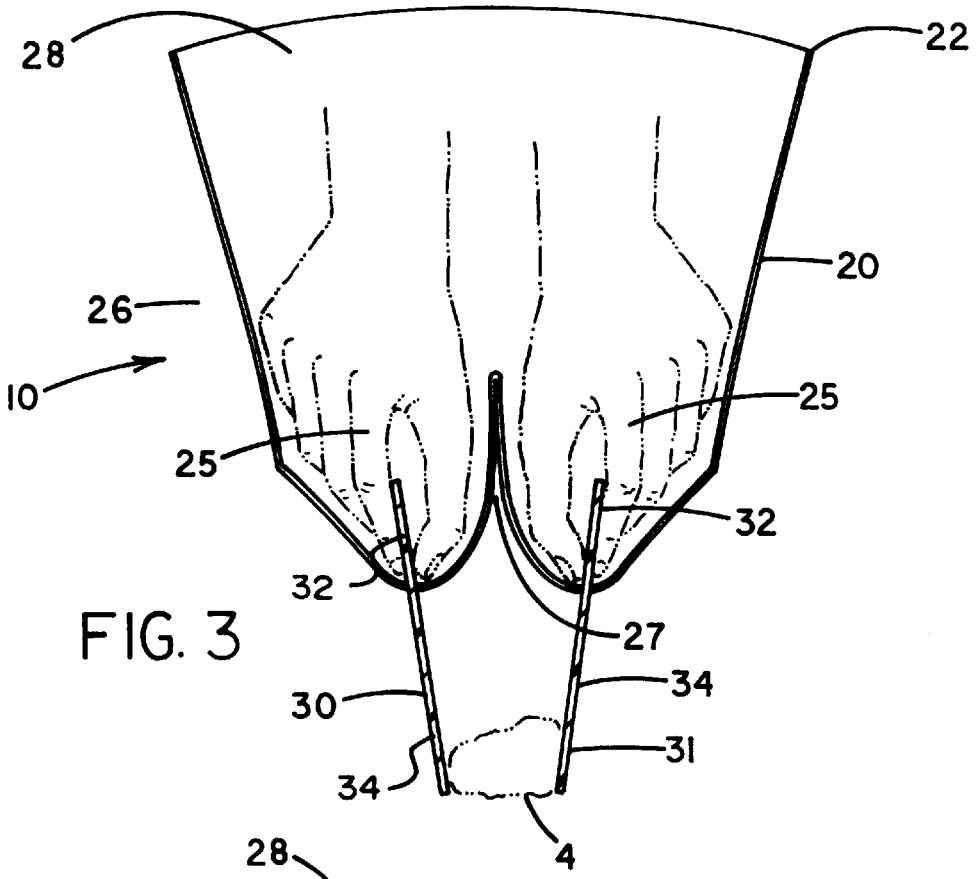
FIG. 3 is a schematic view of the present invention in use.
Figure 4:
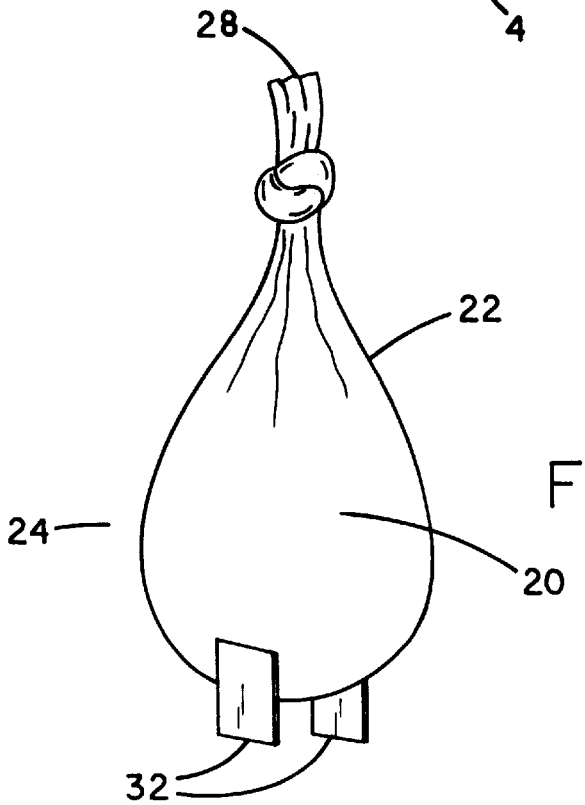
FIG. 4 is a schematic view of the present invention ready for disposal.

As best illustrated in FIGS. 1 through 4, the disposable animal waste receptacle 10 comprises a new disposable animal waste receptacle embodying the principles and concepts of the present invention and generally designated by the reference numeral 10.

The disposable animal waste receptacle 10 is generally comprised of a bag member 20 and a scooping member 30. Generally, the bag member 20 is designed to both provide a physical barrier from, and contain, any material that the user does not desire to have physical contact with, but which does require disposal, such as animal waste.

The bag 20 is defined by a bag wall 22, which separates a bag exterior 26 from a bag interior 24. The bag 20 has a bag opening 28 to allow access to the bag interior 24. The bag opening 28 of the bag 20 occurs where the bag wall 22 is discontinuous. Preferably, the bag wall 22 is also adapted to form two interior pockets 25 in the bag interior 24 to receive a hand of the user. Also preferably, the bag wall 22 is adapted to form an inverted v-shaped exterior pocket 27 in the bag exterior 26. These pockets are preferred to promote ease of use, but the bag 20 could be formed without the interior pockets 25 or the exterior pocket 27.

The bag 20 is preferably formed of a material which is flexible and commonly used for construction of moisture retaining bags. Options include, but are not limited to, plastic or wax-coated paper. The preferred embodiment is a plastic bag to allow easy manipulation of the scooping means by the hands of the user positioned inside the bag 20.

Generally, the scooping means comprises at least one scooping member 30 which permits scooping up the waste 4 and depositing the waste 4 into the bag 20 for disposal. The scooping member 30 is grippable by a hand positioned inside of the bag 20 for manipulation by the hand for scooping. A scooping member 30 with a substantially flat edge and a substantially rectangular shape is considered the most efficient shape for scooping off of a relatively flat surface such as the ground or a floor, although other scooping member 30 shapes may be optionally employed.

Preferably, the scooping means is comprised of a scooping member 30 and a scooping member 31. When two scooping members 30 and 31 are present, they are preferably located on opposite sides of the exterior pocket 27.

The preferred scooping member 30 extends through the bag wall 22 with an interior portion 32 of the member 30 located in the bag interior 24, and an exterior portion 34 of the scooping member 30 located in the bag exterior 26.

Preferably, the exterior pocket 27 is located between scoop member 30 and scoop member 31 wherein each scooping member 30, 31 extends through the bag wall 22 into the interior pockets 25 of the bag 20, such that hands situated in the interior pockets 25 are able to grip and manipulate the scooping members 30, 31 in a coordinated pinching movement. Optionally, the one scooping member 30 extends through the bag wall 22 into the interior pocket 25 of the bag 20, such that a hand situated in the interior pocket 25 is able to grip and manipulate the scoop member 30 while in the interior pocket 25. As an option, the scooping member 30 may be attached to the exterior of the bag wall 22 without passing through the bag wall 22 with the hands of the user manipulating the scooping member.

Most preferably, the interior portion 32 and the exterior portion 34 of the scooping member 30 are substantially equal in size. The scooping member 30 is sized such that the exterior portion 34 will easily fit within the bag 20 upon inversion of the bag 20. The interior portion 32 of the scooping member 30 also fits within the bag 20 with sufficient room to comfortably accept a hand inserted therein.

The scooping member 30 is preferably constructed of material with sufficient stiffness and strength to withstand the force exerted on the scooping member 30 to scoop waste off of a surface and transfer the waste 4 to the bag 20. However, the scooping member 30 should have the flexibility to conform to the surface on which the waste 4 rests for the transfer. The scooping member 30 also has durability to withstand the abrasive action of the scooping member 30 against the surface on which the waste 4 rests. Suitable materials for construction of the scooping member 30 include cardboard, paperboard, and semi-rigid plastic. The preferred embodiment of the scooping member 30 is constructed from a heavy grade of paperboard. The heavy grade paperboard will have the requisite strength, flexibility, and durability to pick up the animal waste. The paperboard will not add substantially to the amount of bulk of the unused receptacle and thus be more easily carried prior to use.

An illustrative embodiment of the disposable animal waste receptacle in a folded condition convenient for storage, for example, in a clothing pocket until use, is about 3¼ inches by about 5¼ inches by about ¼ inch thick. The bag is constructed of polyethylene.

The scooping member 30 is used with the bag 20 to collect and dispose of the waste 4. A hand is positioned inside of the bag 20 and used to grip the scooping member 30. Optionally, each hand of the user may grip the scooping members 30, 31. The user's hand manipulates the scooping member 30 in a scooping motion, or in the embodiment where two members are employed, both hands manipulate scooping members 30 and 31 in a coordinated pinching movement, to scoop waste 4 off a surface. The bag 20 is inverted to contain the waste 4 and the soiled exterior portion 34 of the scooping member 30 for ultimate disposal. The bag 20 may be closed by tying or optionally by closing with a closure such as a twist tie or clip.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A disposable animal waste receptacle for picking up animal waste from a surface and containing the waste for disposal comprising:

a bag having a wall defining an interior for receiving the hands of a user, said wall having an exterior;

a pair of scooping members for scooping up animal waste off of a surface;

each of said scooping members being mounted to said bag, each of said scooping members extending through the wall of said bag such that an interior portion of said scooping member extends into the interior of said bag and an exterior portion of said scooping member extends out of the exterior of said bag, the interior portion of each of said scooping members being manipulatable by one of said hands grasping the interior portion of said scooping member to effect a scooping of animal waste onto said scooping member;

wherein the wall of said bag has an outer surface forming an inverted exterior pocket on the exterior of said bag, said exterior pocket being positioned between the scooping members for receiving animal waste scooped by said scooping members;

wherein the wall of said bag is invertible such that the exterior pocket of the outer surface of the bag is moved into an interior position simultaneous with said scooping members and any animal waste scooped onto said scooping members into said bag for disposal without further handling of said scooping members.

2. The receptacle of claim 1 wherein the wall of the bag has an edge defining an opening into the interior of said bag, and wherein the exterior pocket has a perimeter located opposite of said opening.

3. The receptacle of claim 1 wherein said scooping members are similarly positioned on said bag at substantially separate and spaced locations in said wall of said bag.

4. The receptacle of claim 1 wherein each of said scooping members is substantially rectangular.

5. The receptacle of claim 1 wherein the wall of said bag forms two interior pockets in the interior of said bag with a scooping member extending through the wall of each pocket such that a hand may be inserted into each pocket to manipulate a separate scooping member, each of said interior pockets being positioned with said exterior pocket located between said interior pockets.

6. The receptacle of claim 1 wherein said scooping members are similarly positioned on said bag at substantially separate and spaced locations in said wall of said bag;

wherein each of said scooping members is substantially rectangular;

wherein said exterior pocket is substantially V-shaped;

wherein the wall of said bag forms two pockets in the interior of said bag with a scooping member extending through the wall of each pocket such that a hand may be inserted into each pocket to manipulate a separate scooping member, each of said interior pockets being positioned with said V-shaped exterior pocket located between said interior pockets;

wherein the interior portion of each of said scooping members has a free end opposite the mounting of said scooping member to said bag and an interior length between the free end and the mounting of the scooping member to said bag, and the exterior portion of each of said scooping members has a free end opposite the mounting of said scooping member to said bag and an exterior length between the free end and the mounting of the scooping member to said bag, and wherein the exterior length of said scooping member is about twice the interior length of said scooping member; and wherein the wall of the bag has an edge defining an opening into the interior of said bag, and wherein the V-shaped exterior pocket has a perimeter located opposite of said opening, and wherein the interior of said bag has a depth and said V-shaped exterior pocket has a depth, and wherein the depth of said V-shaped exterior pocket is at least half of the depth of the interior of said bag.

7. A method for disposing of animal waste without contaminating the hands of a user, said method comprising:

(a) providing a disposable receptacle comprising (i) a bag having a wall defining an interior for receiving the hands of the user, said wall having an exterior;

(ii) a pair of scooping members for scooping up animal waste off of a surface;

(iii) each of said scooping members being mounted to and extending through the wall of said bag such that an interior portion of said scooping member extends into the interior of said bag and an exterior portion of said scooping member extends into the exterior of said bag wherein the wall of said bag has an outer surface forming an inverted V-shaped exterior pocket on the exterior of said bag, said V-shaped exterior pocket being positioned between the scooping members for receiving animal waste scooped by said scooping members, the wall of said bag forms two interior pockets in the interior of said bag with a scooping member extending through the wall of each pocket such that a hand may be inserted into each pocket to manipulate a separate scooping member, each of said interior pockets being positioned with said V-shaped exterior pocket located between said interior pockets;

(b) positioning each hand of the user in one of the interior pockets of said bag;

(c) gripping the interior portion of each of said scooping members;

(d) manipulating the scooping members to scoop animal waste off of a surface with the exterior portions of said scooping members.

8. The method of claim 7 including the step of inverting said bag with the interior portions of said scooping members for scooping up animal waste off of a surface such that the exterior portions of said scooping members and any animal waste thereon is brought inside said bag.

9. The method of claim 7 including the step of disposing of said bag with said scooping members and animal waste therein.

10. The receptacle of claim 1 wherein the interior portion of each of said scooping members has a free end opposite the mounting of said scooping member to said bag and an interior length between the free end and the mounting of the scooping member to said bag, and the exterior portion of each of said scooping members has a free end opposite the mounting of said scooping member to said bag and an exterior length between the free end and the mounting of the scooping member to said bag, and wherein the exterior length of said scooping member is about twice the interior length of said scooping member for facilitating the scooping action by the exterior portion of said scooping member.

11. The receptacle of claim 1 wherein the wall of said bag has an edge defining an opening into the interior of said bag, and wherein said exterior pocket has a perimeter located opposite of said opening, and wherein the interior of said bag has a depth and said exterior pocket has a depth, and wherein the depth of said exterior pocket is at least half of the depth of the interior of said bag.

* * * * *